United States Patent [19]

Bacchiere et al.

[11] 4,306,269

[45] Dec. 15, 1981

[54] MAGNETIC CHUCK CONTROL SYSTEM

[75] Inventors: Daniel P. Bacchiere, Niles; Stanley F. Polinski, Chicago, both of Ill.

[73] Assignee: Semi-Controls, Inc., Niles, Ill. ; by said Stanley F. Polinski

[21] Appl. No.: 101,508

[22] Filed: Dec. 7, 1979

[51] Int. Cl.[3] ..... H01F 13/00

[52] U.S. Cl. ..... 361/149

[58] Field of Search ..... 361/145, 143, 149; 335/284, 292, 289, 290

[56] References Cited

U.S. PATENT DOCUMENTS

| | | | |
|---|---|---|---|
| 3,164,753 | 1/1965 | Schroeder | 361/149 |
| 3,368,119 | 2/1968 | Littwin | 361/149 |
| 3,378,734 | 4/1968 | Littwin | 361/149 |
| 3,401,313 | 10/1968 | Littwin | 361/149 |
| 3,532,940 | 10/1970 | Schroeder et al. | 361/149 |
| 3,579,053 | 5/1971 | Littwin | 361/145 |
| 3,609,465 | 9/1971 | Gruetzmacher | 361/149 |
| 4,158,873 | 6/1979 | Schroeder et al. | 361/149 |

*Primary Examiner*—J. D. Miller
*Assistant Examiner*—L. C. Schroeder
*Attorney, Agent, or Firm*—Fitch, Even, Tabin, Flannery & Welsh

[57] ABSTRACT

A magnetic chuck control system employing solid state circuitry including a power output circuit adapted to apply a DC voltage to an object such as a magnetic chuck or the like so as to magnetize the same. The power output circuit employs a triac reversing circuit and is interfaced with a digital control circuit and a digital-to-analog converter circuit so as to apply alternating polarity voltage signals of successively reduced magnitude to the chuck during a demagnetizing operation. All high voltage is confined to the power output circuit so as to provide significant safety protection to the operator.

20 Claims, 6 Drawing Figures

MAGNETIC CHUCK CONTROL SYSTEM

The present invention relates generally to magnetic control systems, and more particularly, to a magnetic control system employing novel solid state circuit means for effecting demagnetizing of an object such as a magnetic chuck and associated ferromagnetic work piece or the like.

It is known that in employing a magnetic chuck to hold a ferromagnetic work piece in a machine tool or the like, the chuck and the work piece, upon deenergizing, retain significant residual magnetism which inhibits release of the work piece from the chuck. It is conventional in such cases to demagnetize the magnetic chuck and associated work piece so as to enable release to the work piece. Such demagnetizing is generally accomplished by passing a current through the chuck, and thereby the associated work piece, in alternating opposite directions by reversing the polarity in a series of steps while lowering the voltage potential in each successive step until the voltage potential reaches substantially zero at which time the chuck and work piece are sufficiently demagnetized to allow the work piece to be readily separated from the magnetic chuck.

A general object of the present invention is to provide a novel magnetic control system which finds particular application in controlling magnetic chucks and the like, and which is adapted to effect demagnetizing of the chuck and associated work piece so as to enable an operator to readily remove the work piece from the chuck.

A more particular object of the present invention is to provide a totally solid state magnetic chuck control system employing a power output circuit interfaced with a digital control circuit and digital-to-analog converter circuit so that the power output circuit is adapted to apply output voltage signals to the chuck of successively decreasing magnitude and alternating polarity during a demagnetizing operation.

Still another object of the present invention is to provide a magnetic chuck control system having a power output circuit connected to a DC power supply and interfaced with a digital control circuit and a digital-to-analog converter circuit operative on the power output circuit to establish output voltage signals to the chuck of alternating polarity and successively decreasing magnitude during a demagnitizing operation, the digital control and digital-to-analog circuit being of low voltage operation and isolated from the high voltage power output circuit so as to protect the operator should a fault current occur in the power output circuit.

A feature of the magnetic chuck control system in accordance with the present invention lies in the provision of a visual display adapted to digitally indicate in decreasing order the various cycles of voltage reversal during a demagnetizing operation and thereby inform the operator when demagnetizing has been completed.

Another feature of the magnetic chuck control system in accordance with the present invention lies in the employment of a digital-to-analog converter circuit for controlling the magnitude of the output signals from the power output circuit to the magnetic chuck, the digital-to-analog converter circuit including a variable output adjustment enabling variation in the incremental decrease between successive output voltage signals applied by the power output circuit to the magnetic chuck.

Still another feature of the magnetic chuck control system in accordance with the present invention lies in the use of triacs in a reversing circuit portion of the power output circuit, the triacs being connected in a bridge type circuit and having their respective gates interfaced with the digital control circuit through optical couplings so as to isolate the digital control circuit from the substantially higher current controlled by the triacs.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 2:
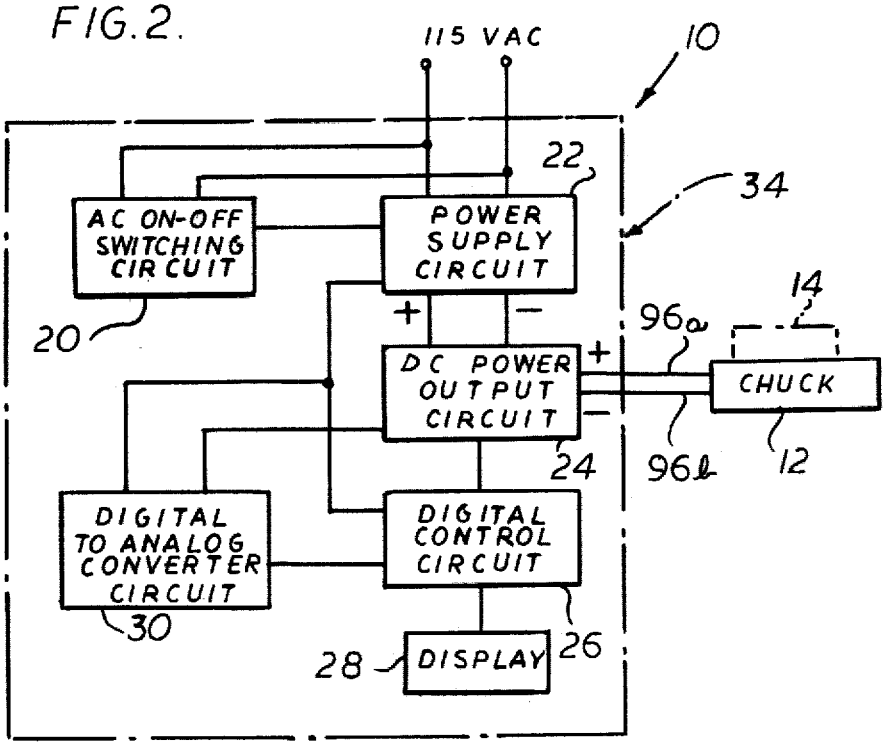
FIG. 2 is a schematic block diagram of the various circuits comprising the magnetic chuck control system of the invention.
Figure 3:
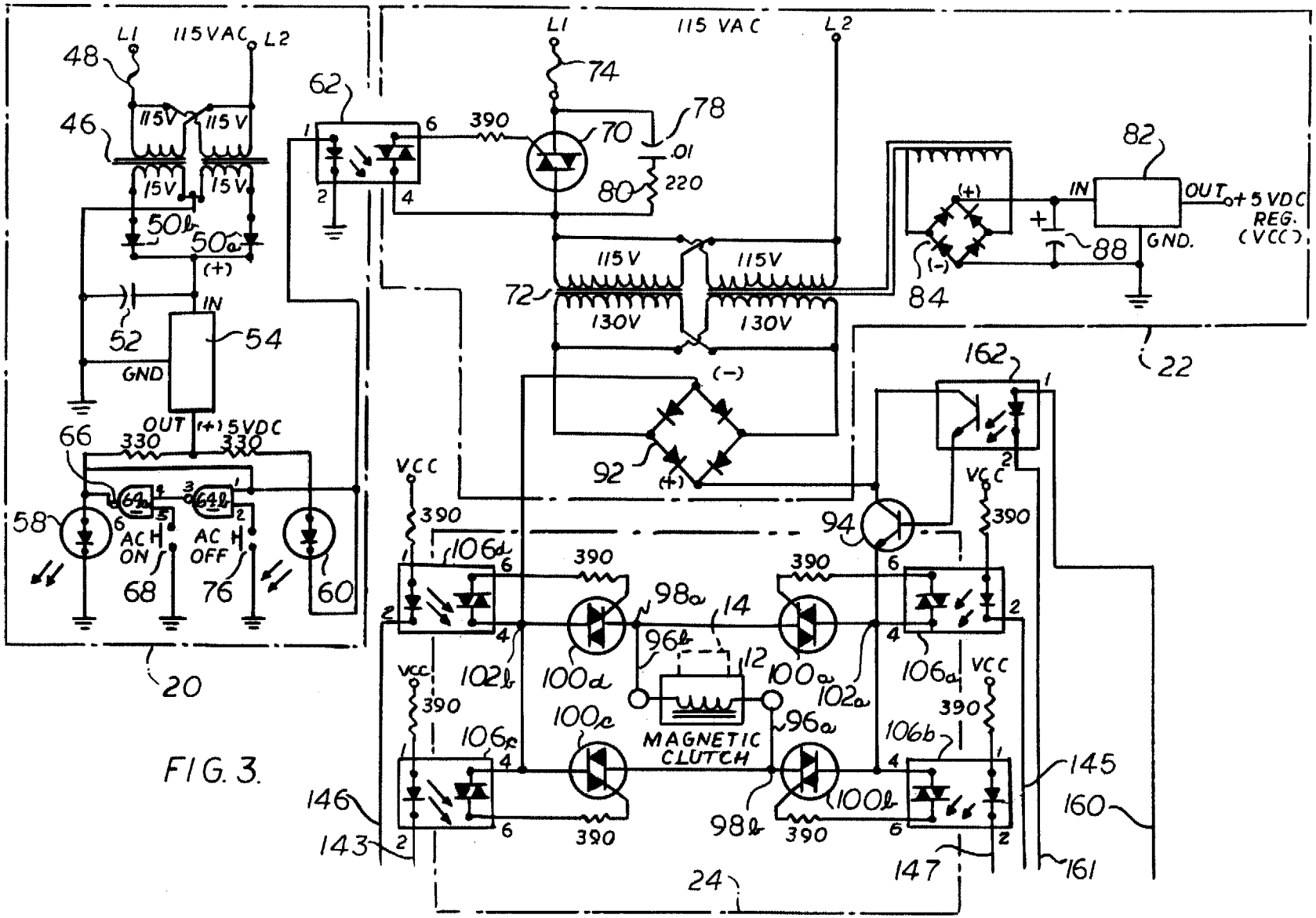
FIG. 3 is a circuit diagram of the power supply circuit, the AC on-off switching circuit and the DC power output circuit of the magnetic chuck control system illustrated schematically in FIG. 2.

The various features of the magnetic control system in accordance with the present invention are described herein, by way of illustration, in conjunction with a control system, indicated generally by reference numeral 10 in FIG. 2, for controlling a magnetic chuck, indicated schematically at 12 in FIGS. 2 and 3. The magnetic chuck 12, which may also be termed an electromagnet, is adapted to have a ferromagnetic work piece or other object, such as indicated in phantom at 14, mounted thereon and magnetically maintained in fixed relation on the chuck during the performance of various operations on the work piece. For example, the magnetic chuck 12 may be employed in a machine tool as a work holder during which various operations may be performed on the work piece. The magnetic chuck 12 may, in turn, be mounted on a reciprocating table or the like, so that the associated work piece 14 is moved in predetermined relation to a tool, or alternatively, the magnetic chuck and associated work piece may be maintained in stationary relation and the tool moved relative to the chuck. Magnetic chucks of the type with which the control system of the present invention may be employed are well known and do not, per se, form a part of the present invention.

Very generally, the magnetic control system 10 includes an AC on-off switching circuit 20 which is connected to a suitable AC power supply, such as a 115 VAC supply, and is also connected to a power supply circuit 22 in a manner to enable energizing of the power supply circuit by the 115 VAC power supply. The power supply circuit 22 includes a bridge rectifier to provide a 115 VDC output which is applied to a DC power output circuit 24 the output of which is connected to the magnetic chuck 12 to facilitate magnetic holding of a ferromagnetic work piece or object 14 on the magnetic chuck. The power output circuit 24 is interfaced with a digital control circuit 26 and a digital-to-analog converter circuit 30 which cooperate to effect demagnetizing of the chuck and associated work piece during a demagnetizing operation as will be described.

The power supply circuit 22 is also adapted to provide a regulated low voltage DC output, such as +5 VDC, to the digital control circuit 26 which establishes digital output pulse signals of predetermined equal interval timed relation and which are counted and displayed on a visual display 28 adapted to provide a digital indication to the operator of the polarity reversal cycle and the polarity of the signal then being applied to the chuck during a demagnetizing operation.

The timed digital pulse signals from the digital control circuit 26 and also applied to the digital-to-analog converter circuit 30 which also receives a +5 VDC power supply from the power supply circuit 22. The digital-to-analog converter circuit 30 is adapted to provide an amplified analog output signal which is applied to the DC power output circuit 24. As will be described more fully below, the power output circuit 24 includes a reversing circuit in the form of triacs connected in a bridge type network and having their gates triggered by the digital control circuit so as to provide precise digital timing. The reversing circuit controls the direction of current flow through the magnetic chuck 12 and thus the polarity of the voltage output signals applied to the magnetic chuck 12 during a demagnetizing operation. The successive voltage signals applied to the chuck 12 are of precise predetermined decreasing magnitude as established by the digital-to-analog converter circuit 30.

Figure 1:
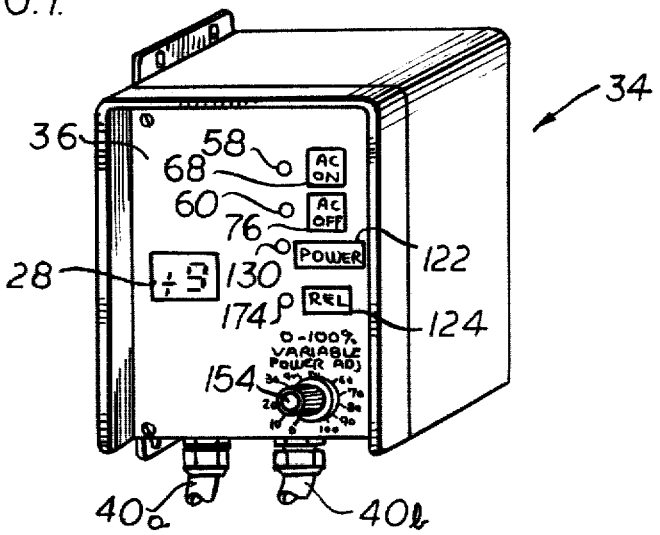
FIG. 1 is a perspective view of a control console containing the various circuits comprising the magnetic chuck control system in accordance with the present invention.

The various circuits 20, 22, 24, 26 and 30 of the magnetic chuck control system 10 are preferably contained within a suitable console or housing such as indicated generally at 34 in FIG. 1. In the illustrated embodiment, the console 34 comprises a generally rectangular housing which is substantially closed on all sides and has a front wall 36 forming a removable control panel on which are mounted the digital display 28 and various switches and associated function indicator lamps as will be described. Suitable tubular conduits 40*a* and 40*b* are connected to the housing 34 for a 3-wire AC power supply and for conductors connecting the DC power output circuit 24 to the magnetic chuck 12.

Figure 4:
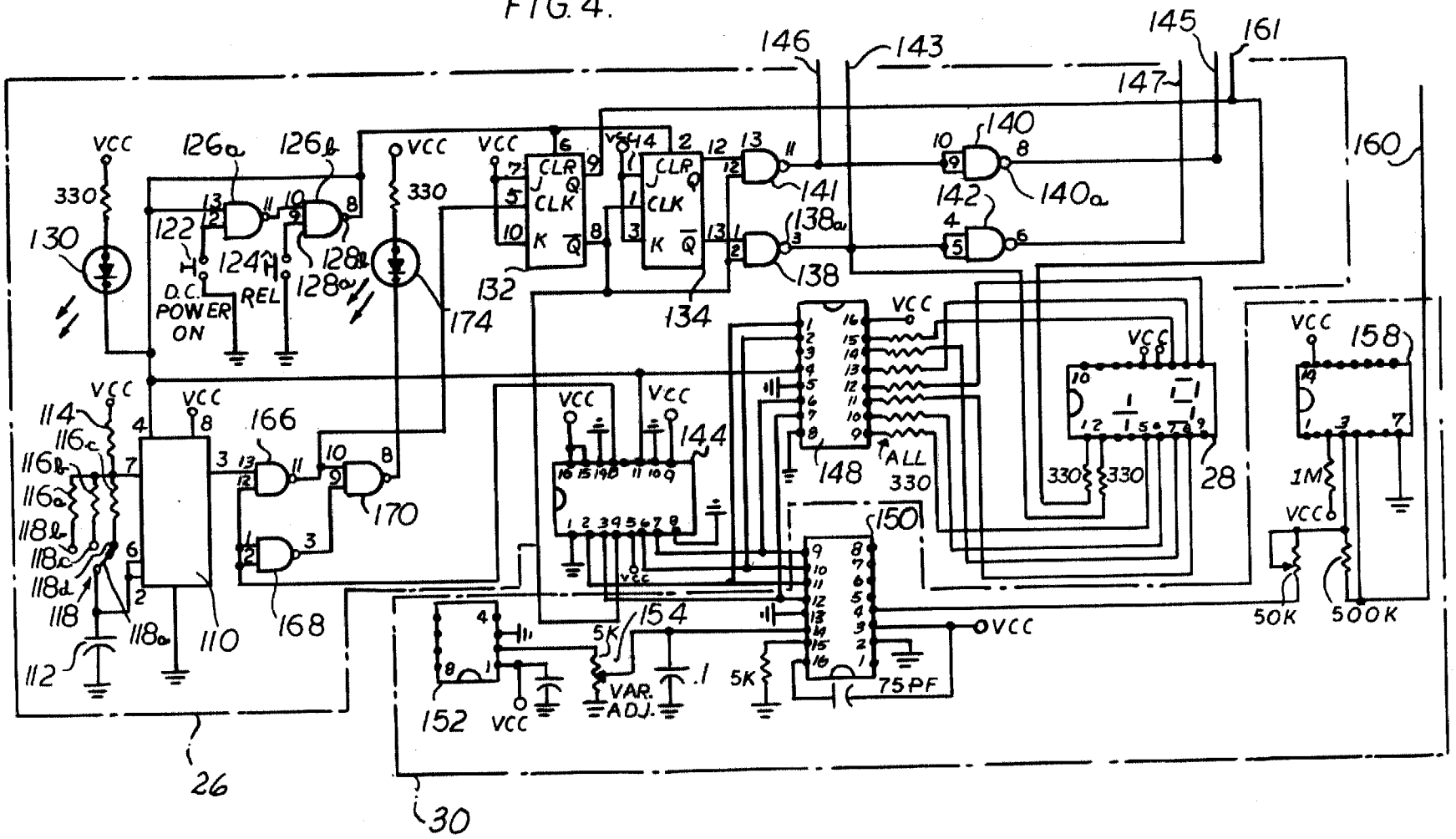
FIG. 4 is a circuit diagram of the digital control and digital-to-analog converter circuits of the magnetic chuck control system illustrated schematically in FIG. 2.

Referring now to FIGS. 3 and 4 for a more detailed description of the various circuits comprising the magnetic chuck control system 10 as illustrated schematically in FIG. 2, the AC on-off switching circuit 20 includes a dual voltage control transformer 46 having its primary connected to the 115 VAC power source through a suitable fuse 48, and having a secondary adapted to provide two 15 VAC outputs which are connected in circuit with suitable diodes 50*a* and 50*b*, a capacitor 52 and voltage regulator 54 to provide a regulated 5 VDC for a light emitting diode (LED) 58, an LED 60, an optically isolated triac driver 62, alternatively termed an optical coupler, and a pair of serially connected NAND gates 64*a* and 64*b*. The NAND gates 64*a* and 64*b* form a bistable switch having an output at 66 which can assume logic states "0" or "1". Logic "0" is ground and "1" is approximately 5 VDC.

The LED 58 may comprise an individual lamp of T-1¾ size adapted to give off a red light when energized, and is mounted on the panel 36 of the console 34 as illustrated in FIG. 1. Similarly, LED 60 may comprise a similar size lamp adapted to give off a yellow light and is mounted on the control panel 36 to underlie lamp 58. An AC normally open "on" switch 68, which preferably comprises a sealed membrane type switch such as commercially available from Sheldahl Corporation, is connected between ground and the NAND gate 64*a* so that closing switch 68, termed the AC "on" switch, establishes a "1" level at output 66 of NAND gate 64*a* so as to turn on LED 58 and enable the optical coupler 62 to turn on so as to energize a triac 70, thus enabling the primary of a main power transformer 72 in the power supply circuit 22 to be energized by the 115 VAC power source through a fuse 74.

A switch 76, which also is a normally open preferably sealed membrane type switch similar to switch 68, is connected between ground and NAND gate 64*b* so that closing the switch 76 establishes a "0" level at the output 66 of NAND gate 64*a*. This turns off the optical coupler 62 and LED 58 and turns on LED 60. Turning off optical coupler 62 deenergizes the triac 70 and removes the AC voltage from the primary of the transformer 72. A capacitor 78 and a resistor 80 are connected across the triac 70 so as to form a phase shift network to enable triac 70 to turn on and off.

The switches 68 and 76 are preferably mounted on the control panel 36 adjacent the LEDs 58 and 60, respectively, so that LED 58 provides an indication that the primary of transformer 72 is connected to the 115 VAC supply while LED 60 provides a visual indication that the primary of transformer 72 is disconnected from the 115 VAC source or is "off".

With the primary of power transformer 72 turned on, a regulated +5 VDC is derived from a 5 VDC regulator 82 connected in circuit with a suitable filter capacitor 84 and the output of a bridge rectifier 86 connected across the output of the low voltage secondary of transformer 72. The regulated +5 VDC provides a low voltage power supply to the digital control circuit 26 and the digital-to-analog converter circuit 30 as aforementioned.

The power supply circuit 22 also includes a power bridge rectifier 92 connected across parallel 130 VAC secondaries of the power transformer 72 and adapted to provide a +115 VDC output which is applied to a power transistor 94, controlled by the digital-to-analog circuit 30 in a manner to be described. The DC power output circuit 24 is connected to the magnetic chuck 12 through conductors 96*a* and 96*b*, alternatively termed the magnetic chuck terminals, which are connected to a set of output terminals 98*a*, *b* of a reversing circuit, indicated generally at 100, which is in the form of a bridge type network and has a set of input terminals 102*a*, *b* connected, respectively, to the power transistor 94 and to the minus terminal of the bridge rectifier 92.

The reversing circuit 100 includes four triacs 100*a*, *b*, *c* and *d* each of which is connected in a leg of the bridge type network reversing circuit. Each triac 100*a*, *b*, *c* and *d* has its gate operatively coupled to the digital control circuit 26 through an associated optical coupler 106*a*, *b*, *c* and *d*, respectively, which serves as an optically isolated triac driver and enables selective switching of the corresponding triac into conducting and nonconducting states through the application of a relatively low voltage signal to the associated triac gate. The optical couplers 106*a, b, c* and *d* are of conventional design and have very high resistance to current flow in a direction toward the digital control circuit 26 so as to isolate and protect the digital control circuit from any power surges or erratic signals in the power output circuit. In this manner, all high voltages are confined to the output circuit 24 and the highest potential to which the digital control circuit 26 and display 28 may be subjected, and also switching circuit 20 and converter circuit 30, is the low +5 VDC power supply from supply circuit 22. The triacs 100*a, b, c* and *d* define bidirectional current control means selectively connected between the output terminals 98*a, b* and the input terminals 102*a, b* of reversing circuit 100 so as to enable selective directional current flow through the magnetic chuck 12 by providing means for alternately switching the polarity of the voltage signals applied to the terminal connectors 96*a,b* of the magnetic chuck. The triacs 100*a, b, c* and *d* also serve to absorb voltage spikes generated by the magnetic chuck whenever the polarity across it is switched.

The digital control circuit 26 includes an oscillator or digital timer 110, such as a commercially available No. 555 timer, which has its pin terminal 8 connected to the +5 VDC power supply of power supply circuit 22 and has its pin terminal 1 connected to ground. The frequency of the oscillator 110 is determined by a capacitor 112, a resistor 114 and a selected one of three resistors 116*a, b* and *c* which are connected to form an R-C network coupled to the oscillator 110 at its pin connections 2, 6 and 7 as illustrated in FIG. 4. A switch 118 provides factory or field means for selectively adjusting the rate at which the polarity of the voltage signals applied to chuck 12 by power output circuit 24 are reversed during a demagnetizing operation, and also the rate at which the output across the chuck will decay to zero VDC. In the illustrated embodiment, the switch 118 includes a manually movable contact arm 118*a* and three fixed contacts 118*b, c* and *d*. Selective connection of contact arm 118*a* with contacts 118*b, c* and *d* enables varying of the time release cycle during demagnetizing between 5, 10 and 20 seconds, respectively.

A normally open DC power ON switch 122 and a normally open DC power OFF switch 124, alternatively termed the release switch, are preferably of the sealed membrane type similar to switches 68 and 76 so as to be momentarily closed when depressed and are mounted on the control panel 36 as shown in FIG. 1. The switches 122 and 124 are connected, respectively, between ground and associated series connected NAND gates 126*a* and 126*b* which are in turn connected in series with pin 4 of oscillator 110. Closing switch 122 causes terminal 128*b* of NAND gate 126*b* to go to "0" and also causes pin 4 on the oscillator to go to "0" and effect stopping of the oscillator. Closing switch 122 also serves to turn on an LED 130 which preferably is mounted on the panel 36 adjacent the DC power ON switch 122 to provide a red visual indication that the DC power is on.

A pair of J-K flip-flops 132 and 134 are cascade connected and serve as a divider. Closing switch 122 causes their "clear" terminals, pins 6 and 2, respectively, to go to zero which resets the divider 132–134 and forces pins 12 and 13 of flip-flop 134 to go to "0" and "1", respectively. These signals from flip-flop 134 force the output 138*a* of a NAND gate 138 and the output 140*a* of an inverter 140 to "0". The "0" signals from NAND gate 138 and inverter 140 are fed to the optical couplers 106*c* and 106*a* through conductors 143 and 145, respectively, so as to turn on the associated triacs 100*c* and 100*a*.

Closing switch 122 also causes pin 11 of a BCD counter 144, also termed a BCD up-down counter, to go to "0" causing the counter to preset to a numerical value as determined by the pins 1, 9, 10 and 15 of counter 144. Such preset numerical value determines the number of pulses applied to the magnetic chuck 12 during a demagnetizing or release cycle. This preset number is also encoded on pins 2, 3, 6 and 7 of counter 144 and is fed to pins 1, 2, 6 and 7 of an LED decoder/-driver 148. The decoder/driver 148 decodes the code signal fed to it from counter 144 and transmits a signal to digital display 28 so that the decoded signal is displayed as a decreasing decimal number on the display 28 during a demagnetizing or release cycle. With the circuit in this condition, the display 28 shows a "+" sign.

The digital display 28 may comprise a seven segment LED display having plus or minus indication. The display 28 is adapted to display as a digital countdown the number of cycles or steps of reverse polarity successively reduced voltage pulses applied to the magnetic chuck 12 during a demagnetizing or release operation and also indicates the polarity of the particular pulse being applied. In the described embodiment, the display 28 will display the number "9" when a demagnetizing cycle is initiated and will countdown until the display reads "0" at which time the voltage potential at the chuck is zero VDC and the demagnetizing sequence is completed. The counter 144 is preferably set so that 10 pulses are established over a time period of 7–8 seconds.

The number encoded on pins 2, 3, 6 and 7 of counter 144 with switch 122 closed is also fed to pins 9, 10, 11 and 12 of a digital-to-analog converter 150 which multiplies the encoded number from counter 144 by a reference voltage as preset at pin 14 of the converter 150. The reference voltage is derived from a precision low voltage reference source 152 through a variable DC output adjustment 154. The setting of the DC output adjustment 154 may be controlled by adjustment knob 154*a* mounted on panel 36 and determines the multiplier at pin 14 of the digital-to-analog converter 150 and controls the analog output voltage at pin 4 of the converter 150.

The analog output voltage from pin 4 of digital-to-analog converter 150 is fed to pin 3 of an operational amplifier 158 which amplifies the analog output signal and applies it to an optically isolated transistor coupler 162 connected in circuit with amplifier 158 through conductors 160 and 161 so as to control the power output transistor 94.

With the triacs 100*a* and 100*c* having previously been turned on by closing switch 122 as aforedescribed, the output voltage from power transistor 94 is applied to magnetic chuck 12 so as to maintain the ferromagnetic work piece or object 14 in substantially fixed relation on the magnetic chuck. The magnitude of the voltage signal applied to chuck 12 is determined by the setting of the variable DC output adjustment 154.

After performing one or more desired operations on the work piece 14, the release and demagnetizing operation of the magnetic chuck control system is initiated by closing switch 124 as by pressing the sealed membrane switch 124 mounted on the control panel 36 which causes LED 130 to turn off. Closing switch 124 forces terminal 128*a* of NAND gate 126*b* to "0" so that a "1" signal appears at terminal 128*b*. Simultaneously, the oscillator 110 begins to oscillate and its output is at pin 3. A decimal number representing a preset value of the counter 144, such as "9", is displayed on the LED display 28 on control panel 36. Pin 4 of the timer 110 goes to "1" as does pin 4 of the decoder/driver 148 and pin 11 of counter 144. At this point, the counter 144 begins to count down the pulses of oscillator 110 applied at pin 4 of the counter as derived from pin 3 of the oscillator through a NAND gate 166 and flip-flops 132 and 134. The output 138*a* of NAND gate 138 and output 140*a* of inverter 140 are now at "1" while the output of NAND gate 141 and output of inverter 142 are at "0".

Signals from NAND gate 141 and inverter 142 are applied to the optical couplers 106*d* and 106*b*, through conductors 146 and 147, respectively, so as to turn on triacs 100*d* and 100*b*. Turning the triacs 100*b* and 100*d* to a conducting or "on" condition reverses the polarity of the DC output voltage at terminals 96*a, b* to the magnetic chuck 12 and decreases its magnitude by a value defined by the quotient of the original DC voltage (i.e., approximately 115 VDC) devided by the total number of predetermined pulses during the release cycle. For example, if an initial voltage of 115 VDC is applied across the magnetic chuck 12 and the counter 144 is conditioned to provide ten pulses during a release cycle or operation, the value by which the output voltage at the magnetic chuck terminals 96*a, b* decreases during each polarity reversal would be 11.5 VDC. Such polarity reversal and successive decreasing of the magnitude of voltage pulse applied to the magnetic chuck takes place at each pulse or "count" of counter 144 and continues until the counter 144 reaches zero at which time the DC output voltage across the chuck 12 will be zero. A "0" signal from pin 13 of counter 144 is fed to a NAND gates 168 and 166 so that the output of a NAND gate 170 goes to zero and turns on an LED 174 which is mounted on the control panel 36 adjacent the DC power OFF switch 124. The LED 174 may, for example, give off a green light which indicates that the release or demagnetizing cycle has been completed. Energizing LED 174 corresponds with a visual display of "0" on the digital display 28, thus indicating to the operator that the release cycle is complete and the work piece 14 may be removed from the magnetic chuck 12.

During the release cycle the following takes place at the terminals 96*a* and 96*b* of magnetic chuck 12. A DC voltage appears as a "+" polarity at 96*b* and *a* "−" polarity at 96*a* through triacs 100*a* and 100*c*. The optical coupler 106*a* is turned on with the output of NAND gate 138 at "0", and 106*c* is turned off when the output of inverter 140 goes to "1". The power transistor 94 is turned off by means of the optical coupler 162 when a "1" signal appears at pin 9 of flip-flop 132. The triacs 100*a* and 100*c* remain in a conducting state or "on" condition from the stored energy in the inductive load of the chuck and work piece which maintains the voltage across triacs 100*a* and 100*c*. The optical couplers 106*a* and 106*b* are turned on when the output signals of inverters 140 and 142 go to "0" momentarily. The timing sequence is governed by the J-K flip-flops 132 and 134.

Turning on the optical couplers 106*a* and 106*b* turns on the corresponding triacs 100*a* and 100*b* forming a crow-bar short across the chuck terminals 96*a, b* so as to dissipate the stored energy in the inductive load. As this energy is dissipated, the voltage across the two triacs 100*a* and 100*b* goes to zero at which time triacs 100*a, b* turn off.

Substantially simultaneously with turning off the two triacs 100*a*, and 100*b*, the power transistor 94 and triacs 100*b* and 100*d* turn on and a DC voltage signal appears at the chuck terminals 96*a, b* which has been decreased a predetermined stepped amount and is of opposite polarity from the immediately preceeding voltage signal applied to the chuck. It will be understood that since the output of the digital-to-analog converter 150 is applied to the base of the output power transistor, successively decreasing the output signals from the converter 150 decreases the power transistor conductance and thus varies the potential at the output terminals of the power output circuit 24.

The optical coupler 106*b* remains on from the output 138*a* of inverter 142 being at "0". The power control transistor 94 and 106*d* are then turned off. Triacs 100*b* and 100*d* remain on from the stored energy in the chuck and work piece. Optical couplers 106*a* and 106*b* are again turned on momentarily in timed sequence governed by the J-K flip-flops 132 and 134. The triacs 100*a* and 100*b* then turn on so as to form a crow-bar short across the output terminals 96*a, b* at the chuck 12 to again dissipate the stored energy in the inductive load. This process repeats itself until the counter 144 reaches the number zero at which point the release cycle is complete as indicated by turning on of the LED 174 and the display of a "0" on the digital display 28. By being digitally controlled, the successive voltage reductions to the chuck are linear; that is, the voltage reductions are in precise equal steps. The final voltage applied to the chuck is exactly zero.

Figure 5:
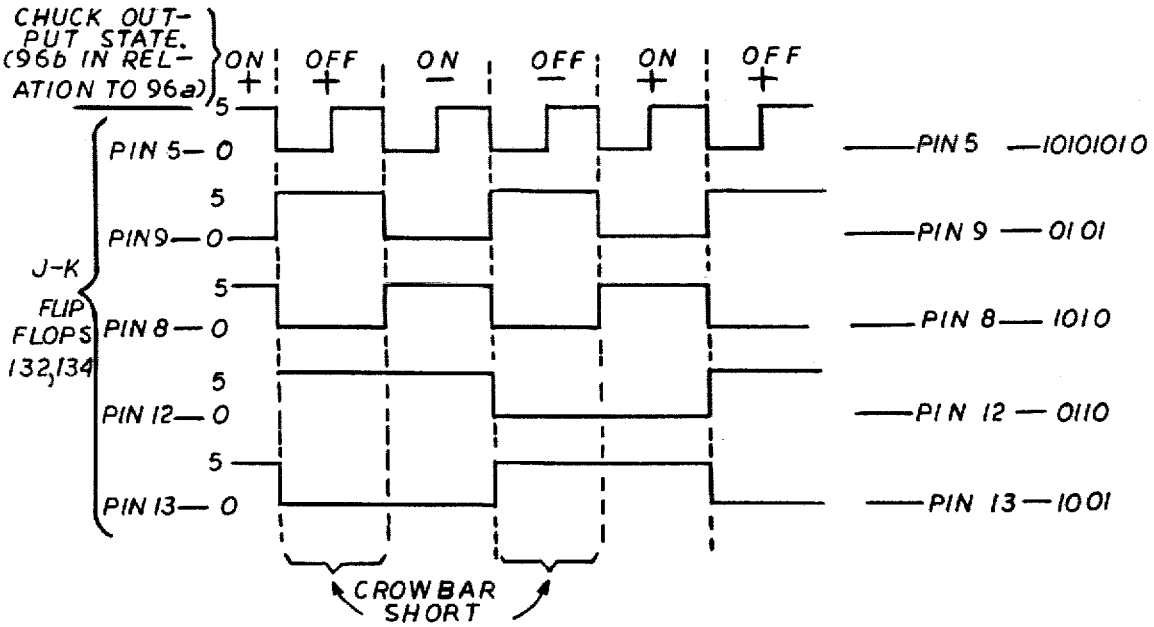
FIG. 5 is a logic diagram illustrating the various logic states of the magnetic chuck in relation to the digital control circuitry.
Figure 6:
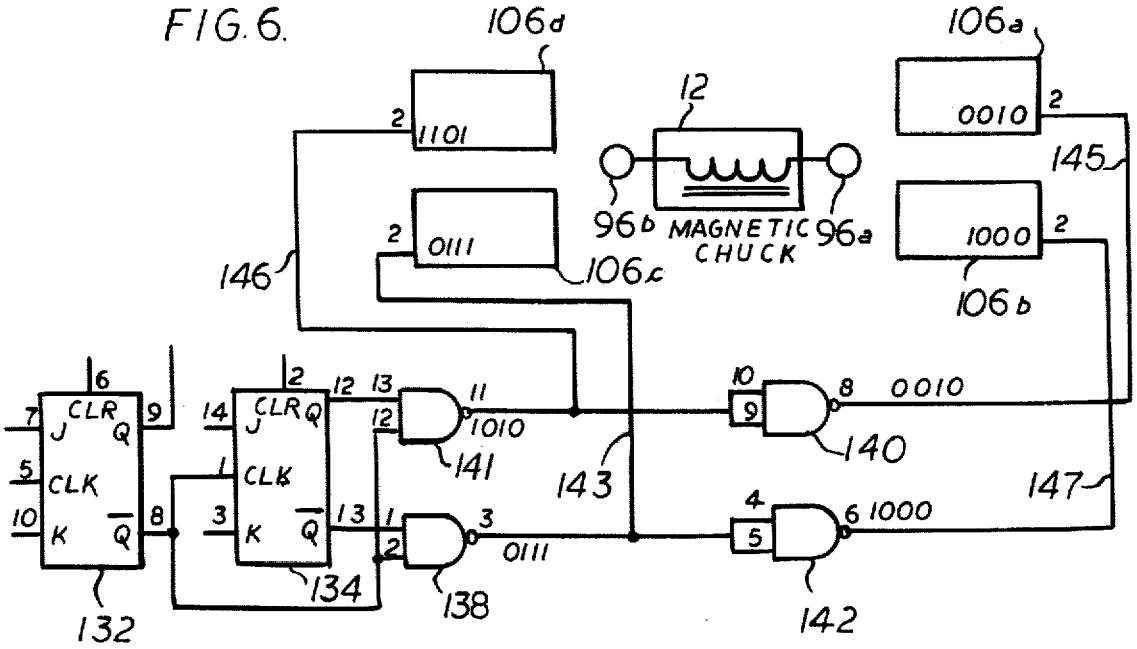
FIG. 6 is a schematic diagram showing the relation of the various logic states of the optical couplers for controlling current flow through the magnetic chuck in relation to the logic states of the associated control circuitry.

FIGS. 5 and 6 illustrate, respectively, a logic diagram and a schematic diagram illustrating the optical couplers 106*a, b, c* and *d* as controlled by the J-K flip-flops 132 and 134. The logic diagram of FIG. 5 indicates the various logic states, i.e. "0" or "1", of the various pin connections of the J-K flip-flops 132 and 134, in relation to the corresponding current conduction and polarity states of the magnetic chuck 12. FIG. 6 indicates the logic states, i.e. "0" or "1", of the NAND gates 138 and 141 and inverters 140 and 142, and the corresponding states of the optical couplers 106*a, b, c* and *d*. A "0" on pins 2 of the optical couplers 106*a, b, c* and *d* turns them on while a "1" signal turns them off.

Thus, in accordance with the present invention, a system for controlling a magnetic chuck is provided which employs a completely digital type control circuit portion which is substantially immune to noise and ambient temperature variations such that drifts and erratic operation are eliminated. By employing a relatively low 5 VDC power supply for all circuits except the power output circuit, and by isolating the power output circuit from the remaining circuits through optical couplers, the highest potential that might be realized at the control panel switches in the event of a fault current in the power output circuit would be a harmless 5 VDC. Further, by employing triacs and associated optical couplers in the reversing circuit 100, the control circuitry is protected from any power surges at the output of the power output circuit 24 at all times, thus assuring elimination of any unexpected or erratic outputs.

In applications where the holding or power output voltage of the power output circuit 24 is to be less than 115 VDC, the only adjustment required is to decrease the reference voltage through adjustment of variable adjustment knob 154*a*, thus making its product with the counter value correspondingly smaller.

In the described embodiment, the various circuit elements which are not indicated on the circuit diagrams of FIGS. 3 and 4 may be selected as follows:

| | |
|---|---|
| NAND gates 64a,b and 126a,b | #7400 Quad NAND gates |
| Triacs 70,100a,b,c and d | Sc 142D Triac 8A-400V |
| Voltage regulators 54 and 82 | #7805 5 VDC Regulators |
| Power transistor 94 | 2N 3902 3.5A-IC 325 VCE |
| Optical couplers 62 and 106a,b,c and d | MOC3010 |
| NAND gates 138,140,141,142 | #7400 Quad NAND gate |
| Counter 144 | #74192 BCD up/down counter |
| LED decoder/drive 148 | #7447 |
| Digital display 28 | MAN6630 1½ Digit Display Common Anode |
| Converter 150 | MC1408L-7 Digital/analog converter |
| Voltage reference source 152 | MC 1403 Low voltage reference |
| Operational amplifier 158 | MC3301 |
| NAND gates 166,168,170 | #7400 Quad NAND gate |
| Optical coupler 162 | 4N25A |

While a preferred embodiment of the present invention has been illustrated and described, it will be understood that changes and modifications may be made therein without departing from the invention in its broader aspects. Various features of the invention are defined in the following claims.

We claim:

1. A system for magnetizing and demagnetizing a magnetizable object, comprising, in combination, a DC power supply, a power output circuit operatively connected to said DC power supply and a magnetizable object and adapted to apply DC voltage signals to the object in a manner to magnetize the object, said output circuit including a reversing circuit enabling reversing of the polarity of said DC voltage signals during demagnetizing, said reversing circuit defining a pair of input terminals connected in circuit with said DC power supply and a pair of output terminals connected to the object, bidirectional current control means selectively connected between said pairs of terminals so as to enable selective directional current flow through the object, a digital control circuit operatively associated with said current control means and operative to effect predetermined sequential conditioning of said bidirectional current control means so as to enable current flow through the object in alternating directions, a digital-to-analog converter circuit cooperative with said digital control circuit and adapted to produce successive output voltage signals of predetermined decreasing magnitude in direct relation to said predetermined conditioning of said bidirectional control means, and means connected in circuit between said DC power supply and said reversing circuit and being responsive to said successive output signals to apply successively decreasing DC voltage signals to the object, said digital control circuit being adapted to control said bidirectional current control means so that said successively decreasing DC voltage signals applied to the object are of alternating polarity.

2. The system as defined in claim 1 wherein said digital control circuit is operative to produce discrete digital control signals of predetermined time duration, and including means responsive to said discrete control signals for selectively conditioning said bidirectional current control means for current flow therethrough.

3. The system as defined in claim 2 wherein said digital control circuit includes means enabling selective variation in the time duration of said discrete digital control signals.

4. The system as defined in claim 2 wherein said means for selectively conditioning said bidirectional current control means includes optical coupler means interfaced between said bidirectional current control means and said digital control circuit.

5. The system as defined in claim 2 wherein said reversing circuit comprises a bridge type network having bridge legs connected between alternate ones of said input and output terminals, each of said bridge legs having a triac connected in circuit therein, said digital control means being operatively connected to said triacs so as to enable selective current flow therethrough in direct response to said discrete digital control signals.

6. The system as defined in claim 1 wherein said digital control circuit and said digital-to-analog converter circuit are adapted to effect current flow through said bidirectional current control means in alternate first and second directions establishing alternating opposite DC voltage signal polarities at said object, said digital control circuit being operative to condition said bidirectional control means for current flow therethrough while said successive output signals produced by said digital-to-analog circuit are ceased so that a shorting circuit is created through said reversing circuit from said output terminals after each successive application of a DC voltage signal to the object.

7. The system as defined in claim 1 including means isolating said power output circuit from said digital control circuit and digital-to-analog converter circuit so that the latter are isolated from any fault currents in said power output circuit.

8. The system as defined in claim 1 including a power supply circuit having an AC power supply and a bridge rectifier adapted to establish said DC power supply, and including an AC on-off switching circuit adapted to control connection of said bridge rectifier to said AC power source.

9. The system as defined in claim 2 wherein said digital control circuit is adapted to establish a predetermined number of said digital control signals during a demagnetizing operation, and including display means adapted to provide a visual display representative of the number of voltage polarity reversals to which an object is subjected during demagnetizing.

10. The system as defined in claim 1 wherein said digital control circuit is operative to establish a predetermined number of digital control signals during a demagnetizing operation, said digital-to-analog converter circuit being operative to produce output signals of substantially equal incrementally decreasing voltage magnitude so that the DC voltage signals applied by said power output circuit to the magnetizable object reach zero when the last of said predetermined number of digital control signals is established.

11. The system as defined in claim 10 wherein said digital-to-analog converter circuit includes variable DC output adjustment means enabling selective adjustment of the magnitude of said voltage output signals produced by said digital-to-analog converter circuit.

12. The system as defined in claim 1 wherein said digital-to-analog converter circuit is adapted to establish output signals of equal incrementally decreasing magnitude during a demagnetizing operation.

13. The system as defined in claim 1 wherein said means for applying said successively decreasing DC voltage signals to the object includes a power transistor controlled by said output signals from said digital-to-analog converter circuit, said power transistor being connected in circuit with and between the positive terminal of said DC power supply and one of said input terminals defined by said reversing circuit.

14. The system as defined in claim 5 wherein said triacs have their gates operatively connected to said digital control circuit so that said triacs may be selectively controlled by a relatively low supply voltage applied to said digital control circuit.

15. The system as defined in claim 14 including an optical isolating coupler interconnecting the gate of each of said triacs to said digital control circuit.

16. The system as defined in claim 7 wherein said DC power supply comprises a first relatively high DC voltage supply, and including a second relatively low DC voltage supply harmless to an operator, said digital control and digital-to-analog circuits being connected to said second voltage supply and electrically isolated from said first power supply.

17. The system as defined in claim 8 wherein said AC on-off switching circuit includes a low voltage regulator adapted to provide a harmless low voltage control signal, and including means isolating said on-off switching circuit from said AC power supply circuit but enabling control thereof by said on-off switching circuit.

18. A system for magnetizing and demagnetizing a magnetizable object, comprising, in combination, a first DC power supply, a second DC power supply adapted to provide a humanly harmless DC voltage signal a power output circuit operatively connected to said first DC power supply and a magnetizable object and adapted to apply DC voltage signals to the object in a manner to magnetize the object, said output circuit including a reversing circuit enabling reversing of the polarity of said DC voltage signals during demagnetizing, said reversing circuit defining a pair of input terminals connected in circuit with said DC power supply and a pair of output terminals connected to the object, bidirectional current control means selectively connected between said pairs of terminals so as to enable selective directional current flow through the object, a control circuit operatively connected to said second DC power supply and associated with said current control means in a manner to effect predetermined sequential conditioning of said bidirectional current control means so as to enable current flow through the object in alternating directions, additional circuit means connected to said second DC power supply and cooperative with said control circuit to produce successive ouput voltage signals of predetermined decreasing magnitude in direct relation to said predetermined conditioning of said bidirectional control means, means connected in circuit between said first DC power supply and said reversing circuit and being responsive to said successive output signals from said control circuit to apply successively decreasing DC voltage signals to the object, said control circuit being adapted to control said bidirectional current control means so that said successively decreasing DC voltage signals applied to the object are of alternating polarity, and means isolating said power output circuit from said control circuit and said additional circuit means so that said control circuit and additional circuit means are isolated from any fault currents in said power output circuit.

19. The system as defined in claim 18 wherein said isolating means comprises optical coupler means interfaced between said power output circuit and said additional circuit means.

20. The system as defined in claim 18 wherein said control circuit comprises a digital control circuit, and said additional circuit means comprises a digital-to-analog converter circuit.

* * * * *